US008296874B2

(12) United States Patent
Galati, Jr. et al.

(10) Patent No.: US 8,296,874 B2
(45) Date of Patent: Oct. 30, 2012

(54) BASIN FOR A FOOT SPA

(75) Inventors: Joseph J. Galati, Jr., Brookfield, WI (US); John Meyerovich, Bal Harbour, FL (US)

(73) Assignee: Continuum Footspas, LLC, Brookfield, WI (US)

( * ) Notice: Subject to any disclaimer, the term of this patent is extended or adjusted under 35 U.S.C. 154(b) by 1214 days.

(21) Appl. No.: 11/977,084

(22) Filed: Oct. 23, 2007

(65) Prior Publication Data

US 2009/0100590 A1 Apr. 23, 2009

(51) Int. Cl.
*A47K 3/022* (2006.01)

(52) U.S. Cl. ..... 4/622; 4/541.2; 601/22; 601/158

(58) Field of Classification Search ..... 4/621–622, 4/541.1–541.2, 541.5; 601/15–17, 22, 46, 601/64, 104–107, 154, 157–158, 166; 607/11, 607/44, 86; 297/217.1
See application file for complete search history.

(56) References Cited

U.S. PATENT DOCUMENTS 335,838 A 2/1886 Perkins
D166,402 S 4/1952 Manne et al.
2,709,435 A 5/1955 Kress
3,696,826 A 10/1972 Gruzalski
D227,952 S 7/1973 Costabile et al.
3,881,471 A 5/1975 Grube
4,485,503 A 12/1984 Rolando et al.
4,497,313 A * 2/1985 Kurosawa ..... 601/16
D282,609 S 2/1986 Stulik
4,620,529 A * 11/1986 Kurosawa ..... 601/157
D288,993 S 3/1987 Grimsrud
4,994,648 A 2/1991 Gil
5,044,357 A * 9/1991 Johns ..... 601/166
D346,043 S 4/1994 Galati, Jr. et al.
5,479,666 A 1/1996 Foster et al.
5,683,638 A * 11/1997 Crigler et al. ..... 264/71
D391,408 S 3/1998 Lee
5,729,841 A * 3/1998 Chan ..... 4/622
D424,819 S 5/2000 Galati, Jr. et al.
D434,916 S 12/2000 Galati, Jr. et al.
D435,371 S 12/2000 Galati, Jr. et al.
6,230,345 B1 5/2001 Borrero et al.
6,309,366 B1 * 10/2001 Maxwell ..... 601/166
D450,390 S 11/2001 Tran
D454,705 S * 3/2002 Long et al. ..... D6/336
6,405,390 B2 * 6/2002 Kuen ..... 4/622
(Continued)

OTHER PUBLICATIONS

AmeriSpa web pages, printed in 2007, 6 pages (http://www.amerispa.com/main.html).

(Continued)

*Primary Examiner* — Winnie Yip
(74) *Attorney, Agent, or Firm* — Ryan Kromholz & Manion, S.C.

(57) ABSTRACT

A spa device including a basin with at least one agitation device and at least one foot massaging device. The agitation device is a pipeless fluid jet. The massaging device may be a three piece massaging foot roller which is placed in a cavity in the bottom surface of the basin. The spa device may include electronic controls for controlling the fluid and agitation devices. The spa device electronic control system may include a fluid level sensor. When the fluid level in the basin reaches a predetermined high level the control system turns off the fluid. When the fluid level in the basin reaches a predetermined low level the control system turns off the jets.

20 Claims, 4 Drawing Sheets

U.S. PATENT DOCUMENTS

| | | | | |
|---|---|---|---|---|
| 6,438,768 | B1 * | 8/2002 | Yen | 4/622 |
| 6,503,212 | B2 * | 1/2003 | Park | 601/158 |
| 6,505,358 | B2 * | 1/2003 | Ferber et al. | 4/622 |
| 6,698,038 | B2 * | 3/2004 | Bastia et al. | 4/622 |
| 6,698,039 | B1 | 3/2004 | Park | |
| 6,732,387 | B1 | 5/2004 | Waldron | |
| 6,739,003 | B1 | 5/2004 | Fanuzzi | |
| D498,599 | S | 11/2004 | Luong | |
| 6,880,182 | B2 | 4/2005 | Gruenwald | |
| D508,616 | S | 8/2005 | Ziliani | |
| D509,371 | S | 9/2005 | Natuzzi | |
| D526,505 | S | 8/2006 | Gruenwald et al. | |
| 7,089,608 | B2 * | 8/2006 | Erb | 4/541.1 |
| 7,100,220 | B2 * | 9/2006 | Lev et al. | 4/622 |
| D531,420 | S | 11/2006 | Kita | |
| 7,168,107 | B2 | 1/2007 | Gruenwald | |
| D541,060 | S | 4/2007 | Fugate et al. | |
| D548,987 | S | 8/2007 | McNae | |
| D559,570 | S | 1/2008 | Higgs et al. | |
| D568,485 | S | 5/2008 | Ton | |
| D569,986 | S | 5/2008 | Ton | |
| D571,018 | S | 6/2008 | Ton et al. | |
| D574,502 | S | 8/2008 | Ton | |
| D583,957 | S | 12/2008 | Bromilow | |
| 7,490,374 | B2 | 2/2009 | Fugate et al. | |
| 7,597,390 | B2 | 10/2009 | Galati et al. | |
| D623,448 | S | 9/2010 | Galati et al. | |
| 2004/0117905 | A1 | 6/2004 | Gruenwald | |
| 2004/0177438 | A1 | 9/2004 | Gruenwald et al. | |
| 2004/0244107 | A1 | 12/2004 | Waldron | |
| 2004/0261173 | A1 * | 12/2004 | Chen | 4/622 |
| 2005/0183198 | A1 | 8/2005 | Gruenwald | |
| 2005/0204466 | A1 | 9/2005 | Luong | |
| 2005/0204467 | A1 * | 9/2005 | Bean et al. | 4/622 |
| 2007/0143918 | A1 * | 6/2007 | Cafaro et al. | 4/622 |
| 2007/0226897 | A1 | 10/2007 | Fugate | |
| 2008/0034494 | A1 | 2/2008 | Monteiro | |

OTHER PUBLICATIONS

Belvedere Company web pages, printed in 2007, 7 pages (http://www.belvedere.com/home.aspx).

European Touch web pages, printed in 2007, 8 pages (http://europeantouch.com).

Gulstream Plastics Ltd. web pages, printed in 2007, 7 pages (http://www.gulfstreamplastic.com).

J&A USA web pages, printed in 2007, 10 pages (http://www.jausainc.com).

Lexor Footspas Inc. web pages, printed in 2007, 3 pages (http://www.lexorinc.com).

Salon Equipment, Inc. web pages, printed in 2007, 4 pages (http://www.oasis-se.com/spas/).

ProSpa Inc., web pages, printed in 2007, 2 pages (http://www.prospa1.com/).

Salon Tech, web pages, printed in 2007, 2 pages (http://www.salontech.com/st2007/).

Skyline Beauty Supply Corp.—Whale Spa, web pages, printed Mar. 20, 2008, 6 pages (http://skylinebeautysupply.com).

VNF International, web pages, printed Mar. 20, 2008, 6 pages (http://www.pssnell-service.com/Manufacturer.htm).

T4 Spa Concepts & Design, web pages, printed Mar. 20, 2008, 7 pages (http://www.t4spa.com).

Spa Zi, Division of LC Corp., web pages, printed Mar. 20, 2008, 4 pages (http://www.thespazi.com).

SANIJET—Pipeless Pedicure Equipment, web pages, printed Mar. 20, 2008, 2 pages (http://www.sanijet.com/Products_Pedicure.aspx).

Aqua Spas, web pages, printed Mar. 20, 2008, 3 pages (http://aquaspa1.com).

Beauty Mall Ltd., web pages, printed Mar. 20, 2008, 6 pages (http://beautymallltd.com).

Euro Spa, web page, printed Mar. 20, 2008, 1 page (http://www.princesspedicurespas.com/manufacturer/eurospa.html#bella320).

Solojet, web page, printed in 2007, 1 page (http://solojet.com).

Hydro Systems—The Solo, web page, printed in 2007, 2 pages (back to back) (http://www.hydrosystem.com/hydro4/designer/solo/).

SO Sound Solutions, web page, printed in 2007, 1 page (http://www.sosounsolutions.com/).

* cited by examiner

BASIN FOR A FOOT SPA

BACKGROUND OF THE INVENTION

It is known to provide spa devices such as health spas, whirlpools, and foot spas. In particular, it is known that the treatment of a person's foot may provide therapeutic relief to various points throughout the body. Such spa devices are generally used in commercial and recreational setting for hydrotherapy, massage, stimulation, pedicure and bathing purposes. Such spa devices may be used for spa treatments of both therapeutic and aesthetic varieties.

In a commercial spa setting, spa devices may be in nearly continuous use throughout the day. In such setting it is important that the spa devices can be easily and effectively cleaned, sanitized, and reset for the next customer. It is therefore desirable to provide a device with improved cleaning and sanitizing capability.

Typical spa devices include jets that are connected by pipes. Fluid from the basin is recirculated through pipes and pushed back into the system. Bacteria may linger and is hard to clear. It is therefore desirable to provide a spa device that does not recirculate water.

SUMMARY OF THE INVENTION

The present invention provides a spa device including a basin, at least one agitation device, and at least one massaging foot roller device. The basin includes a cavity defined by a bottom surface and at least one sidewall. The agitation device is coupled to the sidewall of the cavity. The massaging foot roller is disposed within a depression formed in the bottom surface of the cavity. The water agitation device may be a pipeless jet.

The massaging device may be removably rotatably disposed within the depression formed in the bottom surface of the cavity. The massaging device may include a cylindrical massaging portion and a disc coupled to each end of the massaging portion.

The discs may be coupled to the massaging portion by engagement of a projection formed at each end of the massaging portion and an aperture formed in each disc. The massaging portion may include a textured surface.

The spa device may further include a fluid inlet in fluid communication with the basin. The fluid inlet may comprise a generally rectangular opening formed in the sidewall of the cavity.

The basin may further include an overflow channel in fluid communication with the basin.

The invention comprises a spa system including a basin, a massaging foot roller device disposed with the basin, a source of treating fluid coupled to the basin, a fluid control valve for controlling the treating fluid, a selectively operable fluid outlet, a selectively operable fluid agitation device coupled to the basin, a controller operably connected to the fluid control valve and the fluid agitation device, a power source, and an operator input. The controller may operate the fluid agitation device and the fluid control valve. The operator input and the controller may be integrally formed.

A fluid level sensor may be coupled to the basin and operably connected to the controller. The controller may operate the agitation device and the fluid control valve in response to the fluid level sensor.

A temperature sensor may be coupled to the source of treating fluid and operably connected to the controller. A mixing valve may be coupled to the source of treating fluid and operably connected to the controller. The controller may operate the mixing valve in response to the temperature sensor.

A fluid sensor may be coupled to the fluid outlet and operably connected to the controller. A drain pump may be coupled to the fluid outlet and operable connected to the controller. The controller may operate the drain pump in response to the fluid sensor.

The fluid outlet may be a selectively operable drain coupled to a waste line. The fluid outlet may include an overflow channel the overflow channel coupled to the waste line.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
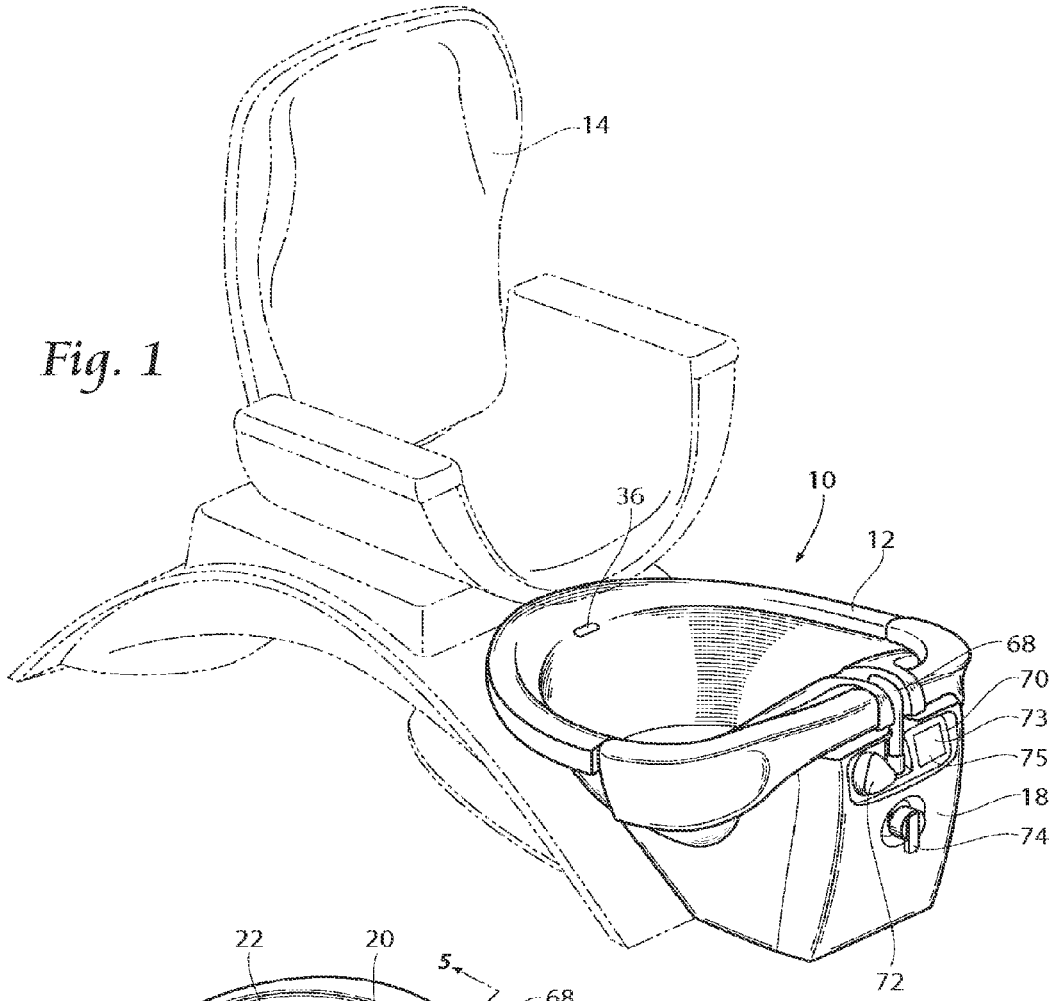
FIG. 1 is a perspective view of a spa device including an embodiment of a spa basin according to the present invention.

An illustrative embodiment of the spa apparatus 10 of the present invention is shown in FIG. 1. The spa apparatus 10 is configured for use in foot massages, pedicures, and other activities related to the feet, including bathing, soaking, simulating, etc. The spa apparatus 10 includes a basin 12. As shown in FIG. 1, the spa device 10 may also include a chair 14 positioned such that the feet of a customer sitting in the chair 14 rest in the basin 12. The chair 14 may be integrally formed to the basin 12, or may be formed separately. If the basin 12 and chair 14 are formed separately, they may either be coupled together, or may simply be placed next to each other for use. It is further contemplated that the basin 12 and the chair 14 may be coupled to each other through a frame 16, as shown in FIG. 1.

The basin 12 generally comprises a cavity 13. The basin 12 preferably includes a base portion 18. In the preferred embodiment, the basin 12 and the base portion 18 are integrally formed, however, it is contemplated that these parts could be formed separately.

The basin 12 is adapted to retain treatment fluid, generally water, for use with various cleaning or massage activities. Although the basin 12 shown in the illustrated embodiment has a generally rounded configuration, the basin 12 may generally take any desired configuration.

Figure 2:
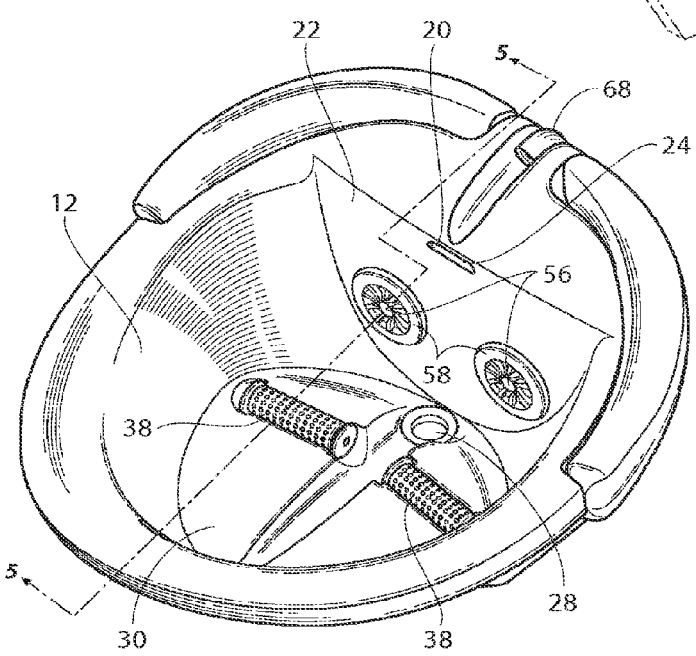
FIG. 2 is a perspective view of the inside of an embodiment of a spa basin according to the present invention
Figure 6:
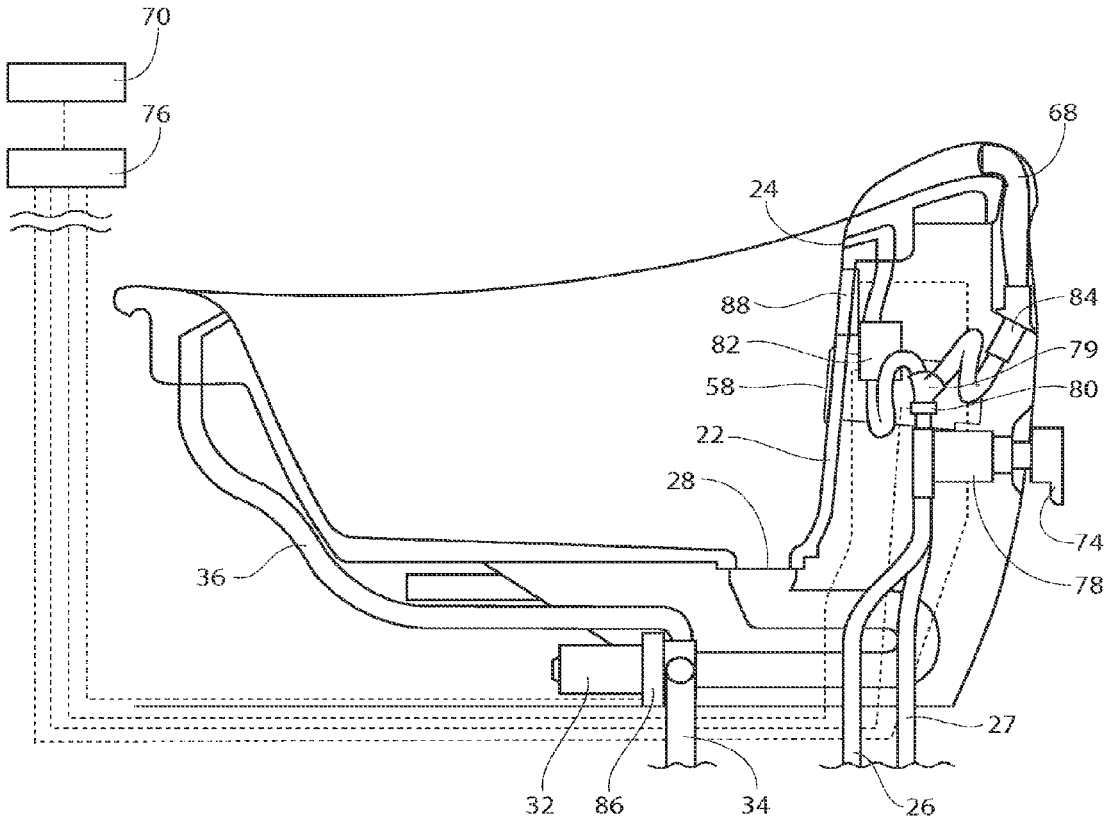
FIG. 6 shows a simplified cross section of the spa basin of FIG. 2 including a diagram of the control signals.

The basin 12 includes a fluid inlet source 20, as shown in FIG. 2. In the illustrated embodiment, the fluid inlet 20 comprises a slot 24 located in the front sidewall 22 of the basin 12. The configuration of the fluid inlet 20 provides a calming cascade of fluid, and reducing the splashing that may occur when using a typical faucet. However, it should be understood that the fluid inlet source 20 could take any other form known in the art, including, but not limited to, a faucet. Treatment fluid to fill the basin 12, such as water, may be provided to the slot 24 through any conventional means. As shown in FIG. 6, in the illustrated embodiment fluid is provided to the slot 24 through a pair of fluid inlet lines 26 and 27. The fluid inlet lines preferably include a hot fluid inlet line 26 and a cold fluid inlet line 27.

As shown in FIG. 2, the basin 12 preferably also includes a drain 28. In the illustrated embodiment the drain 28 is located in the bottom surface 30 of the basin 12. The drain 28 may take any conventional configuration. In the illustrated embodiment, drain 28 is coupled to a waste line 34 through which waste fluid exits the spa device 10, as shown in FIG. 6. It is also contemplated that the drain 28 may include an associated pump 32, as is known in the art and shown in FIG. 6. The associated pump 32 allows the basin 12 to be drained to a remote drain location.

It is further contemplated that it may be desirable to provide the basin 12 with an overflow channel 36, as shown in FIG. 6. The overflow channel 36 will prevent the basin 12 from overflowing if the fluid is accidentally left on. In this manner, if a technician walks away from the spa device 10 while filling the basin 12 the chance of the basin 12 overflowing is minimized. In the illustrated embodiment, the overflow channel 36 is coupled to the waste line 34 to remove waste water from the spa system 10.

As shown in FIG. 2, the basin 12 may be provided with at least one massaging foot roller 38. Now referring to FIG. 3, the massaging foot roller 38 comprises a generally cylindrical massaging portion 40. The surface of the massaging portion 40 may be provided with a textured surface 42. The illustrated embodiment of the textured surface 42 includes a plurality of protrusions 44. However, it is contemplated that any type of texturing known in the art may be utilized.

Figure 3:
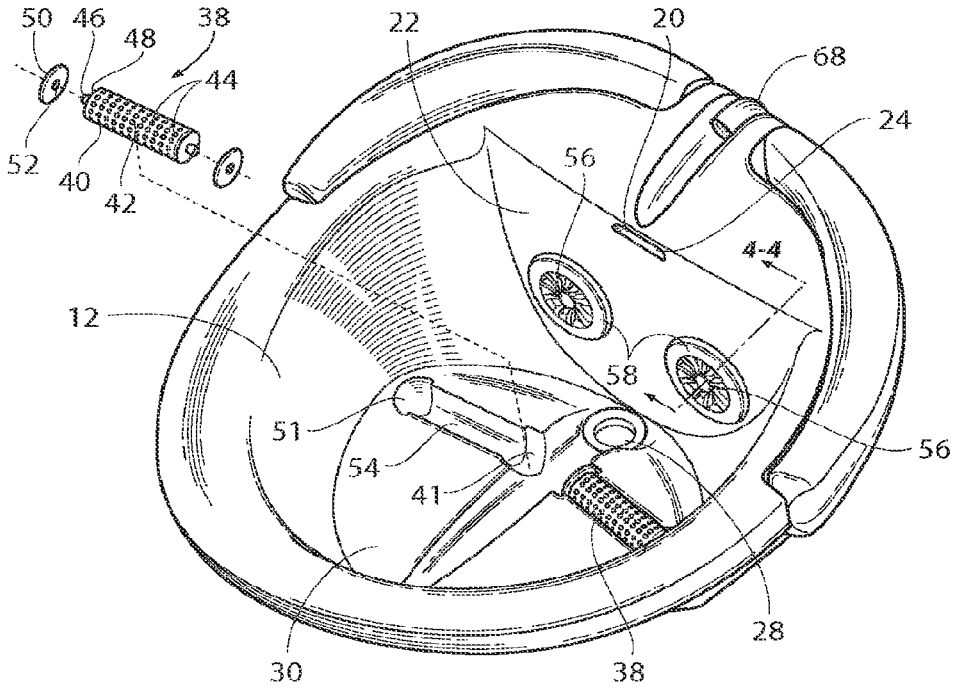
FIG. 3 shows a partially exploded view of the spa basin of FIG. 2.

As shown in FIG. 3, a projection 46 extends from each end 48 of the cylindrical portion 40. In the preferred embodiment the projections 46 are generally cylindrical, however it should be understood that the projections 46 could take many different shapes including but not limited to rectangular, triangular, etc.

FIG. 3 shows a pair of disc members 50 removably coupled to the cylindrical portion 40. Each disc member 50 includes an aperture 52. The aperture 52 is sized and configured to engage with projection 46 formed on the ends 48 of the cylindrical portion 40. In the preferred embodiment the aperture 52 is generally circular, however, it should be understood that the aperture 52 could take many different shapes. For example, if the projection 46 is triangular, the aperture 52 would be a mating triangle. In use, each disc members 50 may be coupled to the foot roller 38 by sliding the disc member 50 on to one of the projections 38 formed on the foot roller 38.

Figure 5:
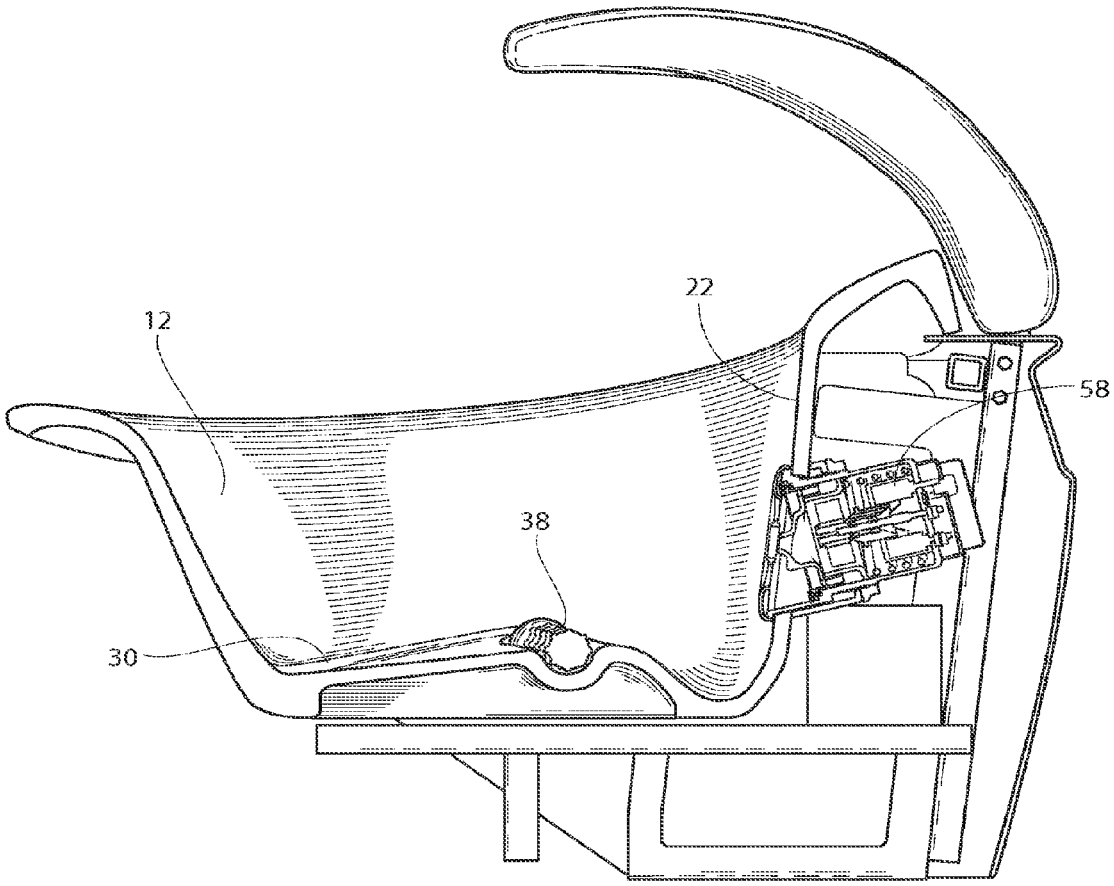
FIG. 5 shows a cross section of the spa basin of FIG. 2 taken along line 6-6.

At least one cavity 54 is formed in the bottom surface 30 of the basin 12, as shown in FIGS. 3 and 5. The cavity 54 is preferably adapted to receive a foot roller 38. In the illustrated embodiment, the shape of the foot roller 38 is such that there is a shallow portion 41 adapted to receive the cylindrical portion 40 and a pair of deeper 51 portions adapted to receive the disc members 50. However, it is contemplated that alternative cavity 54 configurations could be utilized. For example, and not by way of limitation, the cavity 54 could be of a uniform depth. The only requirement is that the textured surface 42 of the cylindrical portion 40 should extend outside of the cavity 54 as shown in FIG. 5. A shown in FIG. 3, the preferred embodiment includes two cavities 54, each of which is adapted to receive a single foot roller 38. However, it should be understood that any appropriate number of cavities 54 may be utilized. For example, a single cavity 54 may be adapted to receive two foot rollers 38, or the basin 12 could be provided with only one foot roller 38 and therefore one cavity 54.

In the preferred embodiment, two disc members 50 are attached to the foot roller 38 as shown in FIG. 3. A first disc member 50 is slid onto the projection 46 on the first end 48 and a second disc member 50 is slid onto the projection on the second end 48. The entire foot roller assembly 38 is then placed into the first cavity 54 formed in the basin 12. This process may then be repeated for the second foot roller 38.

In use, the customer may place his or her feet on top of the foot roller or rollers 38. The customer may move his or her feet back and forth. As the customer moves his or her feet back and forth, the foot roller 38 rotates within the cavity 54 formed in the basin 12. The textured surface 42 of the foot roller 38 provides a massaging sensation to the soles of the customer's foot or feet.

The basin 12 preferably includes at least one agitation device 56 as shown in FIG. 2. The agitation device 56 is adapted to agitate the fluid contained within the basin 12 to provide a massaging sensation to a customer's feet.

The illustrated embodiment includes two agitation devices 56 located in the front sidewall 22 of the basin 12. Although it is contemplated that standard jets such as those used in a whirlpool may be utilized, it is also contemplated that in some circumstances it may be desirable for the two agitation devices to be pipeless jets 58 as shown in FIGS. 4 and 5.

The use of a pipeless jet 58 allows the spa apparatus 10 to be more easily and effectively cleaned. The use of pipeless jets 58 also reduces the amount of plumbing that needs to be installed within the spa device 10, thus reducing installation time and reducing the possibility for leaks or other errors. Additionally, since each of the pipeless jets 58 are independently piped, the pipeless jets 58 may be individually powered and controlled, which allow the user more control.

Figure 4:
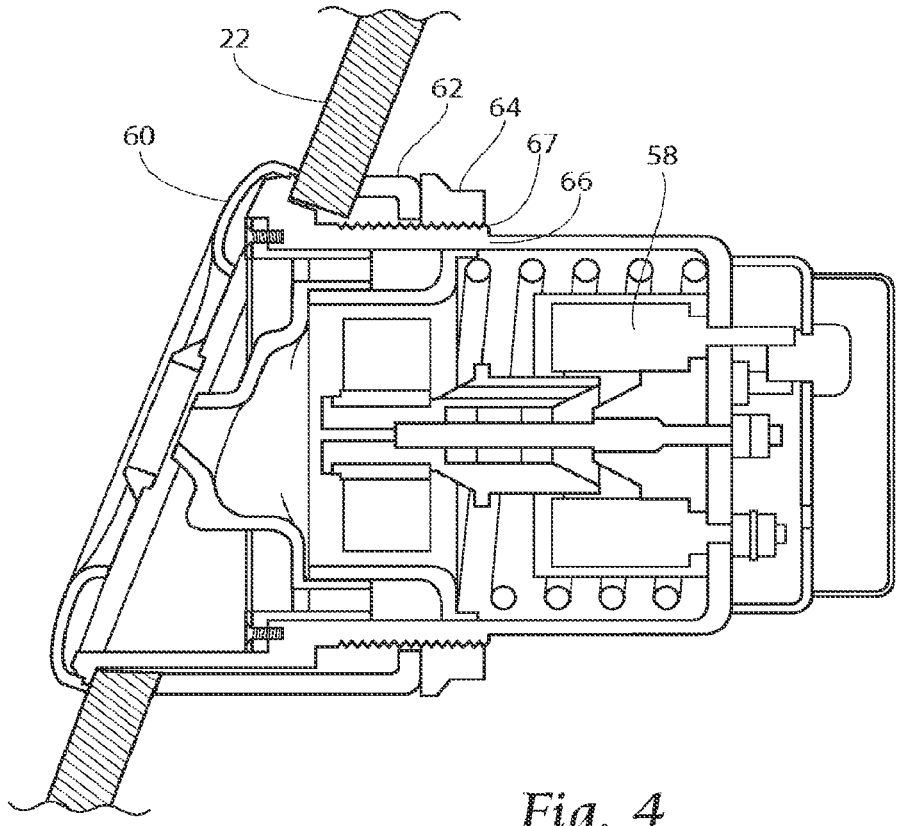
FIG. 4 shows a cross section of an embodiment of a spa jet for use in the spa basin of FIG. 2.

FIG. 4 shows how the pipeless jet 58 of the illustrated embodiment is secured to the basin 12. The body 66 of the jet is placed through an appropriately sized hole in the basin front wall 22. A portion of the body of the jet 58 is formed with threads 67. A spacer 62 is preferably placed around the jet 58 on the outside of the basin 12 and is secured in place by a threaded nut 64. A face plate 60 is placed over the jet 58. In the illustrated embodiment the pipeless jets are manufactured by Venture Research, LLC of Van Nuys, Calif. However, it should be contemplated that any type of pipeless jet could be utilized.

As shown in FIG. 1, the base portion 18 may include various controls associated with the spa device 10. The base portion 18 preferably includes at least a drain control 72, a fluid inlet control 73, and an agitation control 75. In the illustrated embodiment, the fluid inlet control 73 and the agitation control 75 are located on a user interface 70. These controls are generally known in the art. The user interface 70 may be of any type known in the art including, but not limited to a graphical user interface (GUI) or keypad.

It is contemplated that it may be desirable to control the fluid entering and exiting the basin 12 with valves. In the illustrated embodiment, as shown in FIG. 6, the fluid may be controlled by solenoid controlled valve 82, except for the mixing valve 78 which is a manual valve controlled by a handle 74. However, it is contemplated that any type of electrically controlled valves could be utilized.

The solenoid valve 82 aisre in electronic communication, either directly or indirectly, with a fluid control system. The fluid control system includes a controller 76 and a user interface 70. It is contemplated that the user interface 70 could be integrally formed with the controller 76 or that the user interface 70 could be separate from the controller 76, for example the user interface 70 could be a remote control. In this manner the user interface could be located on the basin 12 or at a remote location such as the reception desk of a salon. The controller 76 may take any form known in the art and may preferably be a programmable control device such as, but not limited to, a microcomputer. Preferably, a power source (not shown) is coupled to the controller 76 to provide power to the control system.

The spa device 10 may be used with any type of treating fluid known in the art. Preferably, the spa device 10 is used with water and is connected to plumbing fixtures in the location the spa device 10 is being utilized. As shown in FIG. 6, the spa device 10 preferably includes a hot fluid inlet 26, a cold fluid inlet 27, and a waste line 34. The hot fluid inlet 26 and the cold fluid inlet 27 are coupled to a mixing valve 78. In the illustrated embodiment, the mixing valve 78 is manual. The temperature of the fluid entering the spa device 10 may be controlled via the mixing valve 78, which in the illustrated embodiment includes a rotatable knob 74 which adjusts the valve to provide the desired mix of hot and cold fluid. However, it is contemplated that the mixing valve 78 could be electronically controlled.

The mixed fluid exits the mixing valve 78. The system preferably includes splitting means 79, such but not limited to a t-connection to provide fluid to both the fluid inlet slot 24 and the sprayer 68. A flow valve 82 is located downstream from the splitting means 79 and upstream from the flow valve 82. When the flow valve 82 is open, fluid can flow through the system to the fluid inlet slot 24. A sprayer valve 84 is located downstream from the mixing valve 78 and splitting means 79. When the sprayer valve 84 is open, fluid will flow to through the sprayer 68. When the sprayer valve 84 is closed, fluid will not flow through the sprayer 68. The sprayer valve is preferably of the type known in the art. In the illustrated embodiment, the flow valve 82 is preferably a solenoid valve which responds directly or indirectly to electronic communication generated by the controller 76. The communication between the controller 76 and the solenoid valve 82 could be wired or could be wireless.

Although the illustrated embodiment utilizes a manual mixing valve 78 as shown in FIGS. 1 and 6, it is also contemplated that the mixing valve 78 could be electronic. In this manner, a desired fluid temperature could be entered at the user interface 70. A signal would then be sent to the mixing valve 78, either directly or indirectly, to adjust the mixing valve 78 to achieve the proper temperature. The temperature may be detected by a sensor 80 such as a thermocouple within or adjacent to the mixing valve 78.

As described above and shown in FIG. 6, the waste line 34 preferably comprises a pipe or tube that is coupled to both the overflow channel 36 and the basin drain 28. It is contemplated that the waste line 34 could include a pump 32 which helps quickly and completely drain fluid from the basin 12 to a remote drain location. In some circumstances it may be desirable to provide a sensor 86 in association with the pump. The sensor 86 may be located in the plumbing adjacent the pump 32 or in the pump 32 itself and is adapted to sense when fluid is present. When the sensor 86 senses fluid, it sends a signal, either directly or indirectly, to start the pump 32. It is contemplated that the signal could be sent directly to the pump 32, or that the signal could be sent indirectly to the pump 32 through the controller 76.

In this manner, if the fluid level in the basin 12 reaches the overflow channel 36 and fluid begins to drain, the liquid sensor 86 will sense the fluid and the pump 32 will activate. Additionally, when the basin drain 28 is opened and fluid begins to drain from the basin 12 through drain 28, the liquid sensor 86 for the pump 32 will sense the fluid and activate the pump 32. This allows the basin 12 to be quickly and thoroughly emptied. When fluid is no longer sensed, the pump 32 will be turned off. In this manner, a user, such as a spa technician will not need to be present to operate the pump 32 when the basin 12 is being emptied.

To clean the spa apparatus 10, the fluid is drained from the basin 12. The basin 12 is then refilled with a mixture of fluid and a disinfectant/cleaning agent. The jets 58 are run for a predetermined period of time. The cleaning/sanitizing solution is then drained from the basin 12. A handheld sprayer 68 may be used to rinse the basin 12.

It is further contemplated that the spa apparatus 10 may preferably have an automated "clean"cycle. It is contemplated that the user interface 70 could include a "clean" button or switch that controls the automated cleaning cycle. It is contemplated that the automated cleaning cycle could fill the basin 12 with a predetermined amount of fluid and run the jets 58 for a predetermined amount of time. In the preferred embodiment the clean cycle is automated, except for the addition of the cleaning agent and operation of the drain 28.

In use, the spa technician would manually close the drain 28 prior to running the cleaning cycle. The spa technician would then start the cleaning cycle at the user interface 70. The controller 76 sends a signal to the flow valve 82 to fill the basin 12 with a predetermined amount of fluid. It may also be desirable for the spa technician to add a cleaning solution to the basin 12 during the cleaning cycle. After the predetermined amount of fluid has filled the basin 12, the controller 76 sends a signal to the jets 58 to operate the jets 58 for a predetermined amount of time. After the cleaning cycle is completed, the spa technician would manually open the drain 28 to drain the basin 12.

It is contemplated that the basin 12 could be made of any material known in the art, for example and not by way of limitation, cast iron, stainless steel, ceramic, porcelain, solid surface, composite, or thermoplastic. However, it may be preferably to make the basin 12 of a material that retains heat to keep the spa fluid warm during a spa treatment. It may also be desirable to make the basin 12 of a material that is relatively lightweight in order to make moving the spa device more convenient and to reduce shipping costs. In the preferred embodiment, the basin 12 is made of a solid surface material such as Terreon®.

In some circumstances it may be desirable to provide a fluid level sensor 88 on the basin 12 as shown in FIG. 6. In the illustrated embodiment, the fluid level sensor 88 is located on the outside surface of the basin 12, on the front wall of the basin 12. The fluid level sensor 88 is in electronic communication, either directly or indirectly with the fluid system controller 76. When the fluid level in the basin 12 reaches a predetermined high level, the fluid level sensor 88 sends a signal to the fluid system controller 76. The fluid system controller 76 then sends a signal to the fluid flow valve 82 to close the valve 82 and thus turn the fluid off. In this manner, a spa technician does not need to be at the spa device 10 while the basin 12 is being filled.

It is also contemplated that the fluid level sensor 88 could be used to turn off the jets 58 if the level of the fluid gets too low. When the fluid level reaches a predetermined low level, the fluid level sensor 88 sends a signal to the controller 76. The controller 76 then sends a signal to turns off the jets 58.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A spa device comprising:

a basin, the basin having a cavity, the cavity defined by a bottom surface and at least one sidewall, the bottom surface having at least one depression formed therein;

said basin being constructed of a heat-retaining solid surface material;

at least one agitation device disposed in the at least one cavity sidewall; and at least one massaging foot roller device disposed in the at least one depression in the cavity bottom surface.

2. The spa device of claim 1 wherein the at least one agitation device is a pipeless jet.

3. The spa device of claim 1 wherein the at least one massaging foot roller device is removably rotatably disposed within the at least one depression.

4. The spa device of claim 3 wherein the at least one massaging foot roller device further comprises:

a massaging portion, the massaging portion being generally cylindrical and having a first end, a second end, and a massaging surface; and a first and a second end roller, the first end roller being coupled to the first end of the massaging portion the second end roller being coupled to the second end of the massaging portion.

5. The spa device of claim 4 wherein the first and second ends of the massaging portion are each formed with a projection; and the first and second end rollers are each formed with an aperture, the first end roller aperture being adapted for engaging the first end projection and the second end roller aperture being adapted for engaging the second end projection.

6. The spa device of claim 4 wherein the massaging portion has a textured surface.

7. The spa device of claim 1 further comprising:

a fluid inlet, the fluid inlet in fluid communication with the basin.

8. The spa device of claim 7 wherein the fluid inlet further comprises a generally rectangular opening formed in the at least one cavity sidewall.

9. The spa device of claim 1 further comprising an overflow channel, the overflow channel in fluid communication with the basin.

10. The spa device of claim 1 wherein the heat retaining solid surface material is Terreon®.

11. A spa system comprising:

a basin for retaining treating fluid, the basin having a cavity, the cavity defined by a bottom surface and at least one sidewall, the bottom surface having at least one depression formed therein;

the basin being constructed of a heat-retaining solid surface material;

at least one massaging foot roller device disposed in the at least one depression in the cavity bottom surface;

a source of treating fluid coupled to the basin;

a fluid flow control valve coupled to the source of treating fluid;

at least one selectively operable fluid outlet to remove treating fluid from the basin;

at least one selectively operable fluid agitation device coupled to the basin;

at least one controller operably connected to the treating fluid flow control valve and the at least one agitation device and adapted to open and close the treating fluid flow control valve and to operate the at least one agitation device;

the controller further having a power source operably connected thereto; and the controller further having at least one operator input operably connected thereto, said operator input adapted to provide input to the controller.

12. The spa system of claim 11 wherein the controller and user interface the operator input are integrally formed.

13. The spa system of claim 11 further comprising:

at least one fluid level sensor operably connected to the controller.

14. The spa system of claim 13 wherein the controller is adapted to operate the treating fluid control valve and the at least one agitation device in response to the fluid level sensor.

15. The spa system of claim 11 further comprising:

at least one temperature sensor coupled to the source of treating fluid and operably connected to the controller; and at least one mixing valve coupled to the source of treating fluid and operably connected to the controller.

16. The spa system of claim 15 wherein the controller is adapted to operate the mixing valve in response to the temperature sensor.

17. The spa system of claim 11 further comprising:

at least one fluid sensor coupled to the fluid outlet and operably connected to the controller; and at least one drain pump coupled to the fluid outlet and operable connected to the controller.

18. The spa system of claim 17 wherein the controller is adapted to operate the drain pump in response to the fluid sensor.

19. The spa system of claim 18 wherein the fluid outlet further comprises a selectively operable drain coupled to a waste line.

20. The spa system of claim 19 wherein the fluid outlet further comprises an overflow channel, and the overflow channel being coupled to the waste line.

* * * * *